United States Patent [19]

Vattier

[11] Patent Number: 4,786,021

[45] Date of Patent: Nov. 22, 1988

[54] ARTICLE OF FURNITURE HAVING A BASE FITTED WITH CASTORS

[76] Inventor: Claude Vattier, rue Lavoisier B.P. n° 78, 76200 EU, France

[21] Appl. No.: 16,040

[22] Filed: Feb. 18, 1987

[30] Foreign Application Priority Data

Feb. 19, 1986 [FR] France ..... 86 02234

[51] Int. Cl.[4] ..... A47B 91/00

[52] U.S. Cl. ..... 248/188; 248/188.8; 248/188.7

[58] Field of Search ..... 248/188.1, 188.7, 165, 248/188.8, 188; 280/79.1 R, 79.3; 108/153, 156; 16/31 R, 39

[56] References Cited

U.S. PATENT DOCUMENTS

| | | | |
|---|---|---|---|
| 2,256,677 | 9/1941 | Jones | 248/188.7 |
| 2,830,825 | 4/1958 | Webber | 280/79.3 |
| 3,041,085 | 6/1962 | White | 280/79.3 X |
| 3,622,113 | 11/1971 | Wehner | 248/188.7 |
| 3,719,818 | 3/1973 | Porter | 248/343 X |
| 4,318,570 | 3/1982 | Adam | 248/188.7 X |
| 4,515,087 | 5/1985 | Kurrasch | 108/147 |
| 4,527,829 | 7/1985 | Fanslau | 297/347 X |
| 4,573,415 | 3/1986 | Ramey | 248/188 X |

FOREIGN PATENT DOCUMENTS

| | | | |
|---|---|---|---|
| 1813212 | 7/1969 | Fed. Rep. of Germany . | |
| 1654261 | 11/1971 | Fed. Rep. of Germany . | |
| 2439694 | 3/1976 | Fed. Rep. of Germany | 248/188.8 |
| 2155616 | 5/1973 | France . | |
| 2532038 | 2/1984 | France . | |
| 2568326 | 1/1986 | France . | |

*Primary Examiner*—Alvin C. Chin-Shue

*Attorney, Agent, or Firm*—Armstrong, Nikaido, Marmelstein & Kubovcik

[57] ABSTRACT

This base consists of at least two bars which are substantially parallelepipedal in section, each having an upper web and a lower web forming, respectively, the upper surface and lower surface of the bar and each fitted with at least one castor. Each bar also has an intermediate web parallel to the upper and lower webs and situated between them and having for each castor a portion cut away to accommodate the castor, each of these castors being attached to the said intermediate web. Application to the manufacture of furniture such as trolleys, chairs and the like and movable equipment for supporting objects.

9 Claims, 2 Drawing Sheets

ARTICLE OF FURNITURE HAVING A BASE FITTED WITH CASTORS

FIELD OF THE INVENTION

The present invention relates to an article of furniture having a base fitted with castors, for example a trolley, a chair or the like.

The term "furniture" should be understood in the context of the present invention to mean both furniture properly speaking and movable devices on which objects can be supported.

BACKGROUND OF THE INVENTION

It is known to provide swivelling castors on furniture which is frequently moved, such as the type of furniture used for carrying large objects or numerous products which are to be transported together. As example of such furniture may be mentioned the tables used for television sets, radio telephones, teletransmission equipment, apparatus for computer terminals, etc. In all known furniture of this kind, however, the castors are placed underneath hollow or solid bars which are substantially parallelipiped in form. This has the disadvantage of making the furniture unstable in that it is a if perched on these castors.

SUMMARY OF THE INVENTION

One of the objects of the present invention is an article of furniture having a base fitted with castors so designed that the furniture will be more stable than hitherto and virtually as stable as the same article of furniture not standing on castors, that is to say resting with its base directly on the ground.

It is another object of this invention to propose such furniture in which the aesthetic qualities are improved without significant increase in the manufacturing costs.

These objects and others which will be apparent from what follows are achieved by an article of furniture having a base fitted with castors, which base is formed by at least two substantially parallelipied bars each having an upper web and a lower web forming, respectively, the upper and lower surfaces, each bar being fitted with at least one castor, the said furniture being characterised according to the present invention in that each bar also has an intermediate web parallel to the upper and lower webs and situated between them and having a portion cut away for the accommodation for each castor, each of these castors being attached to the intermediate web.

Each bar preferably has such a cut-out portion situated near an end.

This end is advantageously closed by an end piece with tongues extending into the space between the upper and the intermediate web. This end piece may have a nut which is attached to the two tongues and into which the castor is screwed to fix the castor to the bar.

According to a preferred embodiment of the present invention the piece of furniture has a base consisting of two parallel bars each having a portion cut away at each end. Such an article of furniture advantageously has two upright columns each attached to one of the bars and connected to one another by at least one connecting element and supporting a tray or the like at the top.

Each upright column is preferably attached to its bar by at least two barrel screws, the lower and the intermediate web of each bar having two corresponding apertures substantially of the same diameter as the barrel of the screw while the upper web has an aperture of substantially the same diameter as the threaded part of the screw, and the distance between the upper and the intermediate web being at least equal to the height of the barrel of the screw.

Each vertical column is preferably flat in cross-section and preferably has two tubular longitudinal elements each of which can cooperate with the threaded part of the corresponding barrel screw.

Each connecting element is preferably attached to each upright column by at least one barrel screw having a barrel which is at least equal in length to the thickness of the column less the thickness of one wall of the column. The barrel of the screw therefore does not pass through that wall of the column which is opposite to the one to which the connecting element is fixed but bears against the thickness of that wall. A tray may be fixed to such a connecting element by screws cooperating with screw tapped recesses in the connecting element.

The tray at the top of the vertical columns is advantageously fixed to the columns by screws cooperating with the longitudinal tubular elements provided on each column. This tray may also have a bar serving as handle on one side. This bar may be, for example, a U-shaped tube or section with its base protruding from the tray and its arms forming lateral boundaries at the opposite ends of the tray.

An article of furniture according to the present invention may have two vertical columns each having at least two vertical grooves on the surfaces facing each other, these grooves having a cross-section which is partly closed in the region where it opens out on to the surface of the column.

The cross-section of these grooves is preferably polygonal or elliptic.

The description given below, which does not constitute any limitation, should be read with reference to the attached figures.

DETAILED DESCRIPTION

Figure 1:
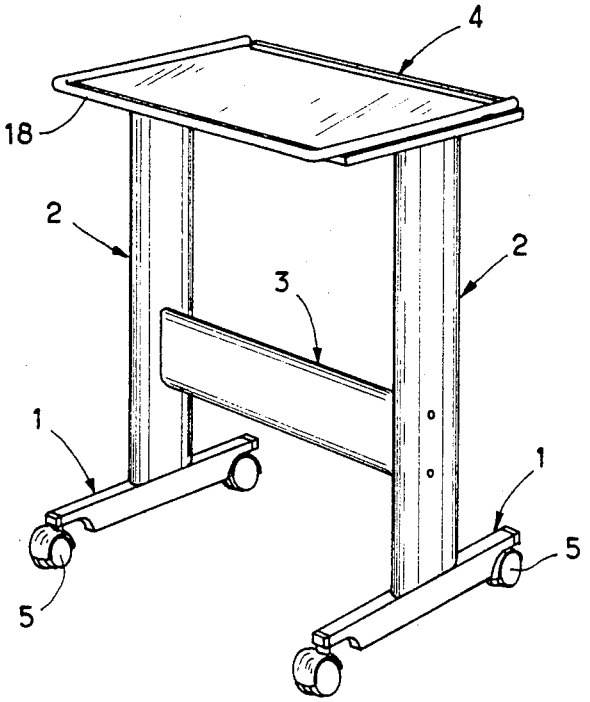
FIG. 1 is a view in perspective of an article of furniture such as a table comprising in particular a base according to the present invention.

As shown in FIG. 1, an article of furniture such as a trolley has a base consisting of two parallel bars 1 and two upright columns 2 which are connected together by a connecting element 3 and which support a tray 4 at the top. Each bar 1 is provided at each end with a castor 5 swivelling about a vertical axis. For certain applications, the castors may be partly or completely replaced by jacks.

Each bar 1 is substantially in the form of a parallelipiped. It has an upper web 6 and a lower web 7 forming, respectively, the upper and lower surfaces of the bar.

According to the present invention, each bar 1 also has an intermediate web 8 which is parallel to the upper and the lower webs and is situated between them and a cutaway portion 9 for accommodating the castor 5. According to the invention, the swivelling castor 5 is attached to the web 8. The cutaway portion 9 is therefore so formed that it enables the castor 5 to swivel about its vertical shaft which furthermore is also the part by which the castor is fixed to the intermediate web 8.

When the swivelling castor 5 is situated near one end of the bar 1, the lower web 7 is shorter than the upper web 6 and the intermediate web 8 by an amount at least equal to the space taken up by the swivelling castor 5. The upper web 6 and intermediate web 8 are equal in length.

It will be clear that such an article of furniture is less expensive to produce than conventional articles of furniture having parts detachably fitted to the ends of the bars forming the base. This reduction in cost is obtained in particular by cutting away a portion of the bar by a simple milling or cutting operation, for example.

Figure 2:
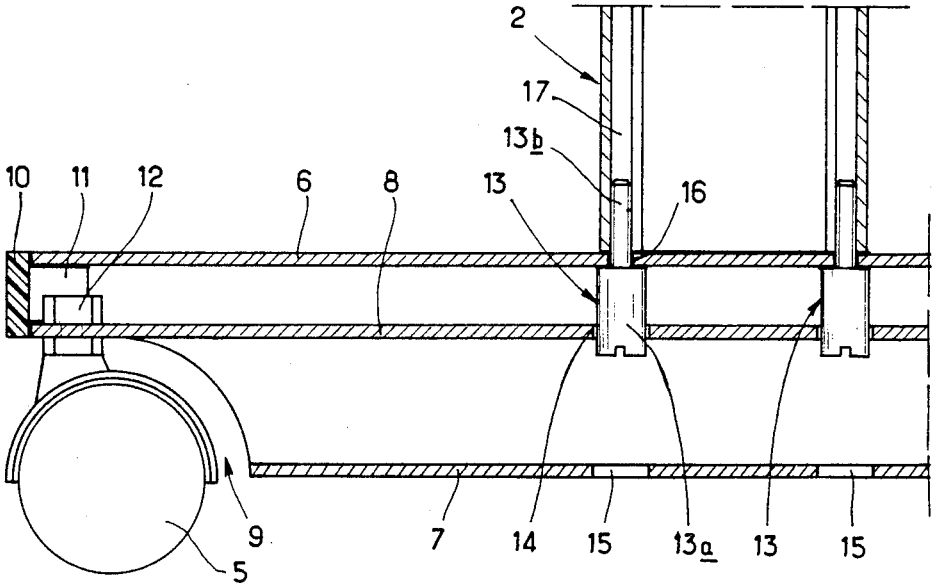
FIG. 2 is a vertical section through a partial side view of the base of the article of furniture shown in FIG. 1.

This end of the bar 1 in which the cutaway portion is situated has an end piece 10 which closes the space between the upper web 6 and the intermediate web 8. This end piece 10 may also have two tongues 11 extending into this space and holding it in position. Furthermore, these tongues 11 which bear against the side walls of the bar 1 may serve to wedge tightly into position the means by which the castor 5 is attached to the intermediate web 8. When these means for attaching the castor consist of a nut 12 as shown in FIG. 2, the tongues 11 can lock the rotation of the nut into which is screwed the threaded shaft about which the castor 5 swivels. In that case, the two tongues may even form an integral part of the nut 12 so that the nut can be introduced into the bar and its rotation locked at the same time. This is an advantageous arrangemenmt for automating the manufacture of such an article of furniture.

As has already been mentioned above, the article of furniture according to this exemplary embodiment also comprises two upright columns each of which is attached to a bar. The attachment of each column 2 to its bar 1 is effected by means of at least two barrel screws 13. The lower web 7 and intermediate web 8 of the bar 1 are provided for this purpose with two apertures 14 and 15 for each screw 13. These apertures have a diameter at least equal to that of the barrel 13*a* of the screw 13 while the upper web 6 has an aperture 16 in alignment with the aforementioned apertures but with a diameter at least equal to that of the threaded part 13*b* of the barrel screw 13. The barrel screw 13 is chosen to have a barrel 13*a* at least equal in height to the distance between the upper web 6 and the intermediate web 8.

In this example, each vertical column is flat in cross-section and has two tubular longitudinal elements 17 each cooperating with the threaded part 13*a* of the corresponding barrel screw 13. A longitudinal element 17 of this kind has been described in particular in French Patent Application No. 79-23171.

To mount the column 2 on its bar 1, the tubular elements 17 are first placed in line with the apertures in the upper web 6. A barrel screw 13 can then be introduced into each aperture 15 of the lower web 7 and screwed into the tubular element 17 until the barrel 13*a* comes into contact with the upper web 6. Since the height of the barrel 13*a* is at least equal to the distance between the intermediate web 8 and the upper web 6, the part of the barrel opposite the threaded part 13*b* of the screw is gripped by the wall of the aperture 14 formed in the intermediate web 8. The screw 13 is therefore held firmly in position no matter from what direction forces are applied to the vertical column 2.

A connecting element 3 may be placed between the two vertical columns 2 of the article of furniture. This connecting element is fixed to each column 2 by at least one barrel screw whose barrel is at least equal in length to the thickness of the vertical column less one wall of the column. The barrel screw is therefore held in position in exactly the same way as the barrel screws used for attaching the vertical columns 2 to their respective bars 1. For the best aesthetic effect, the barrel screw must not pass through that wall of the column 2 which is opposite to the one to which the connecting element 3 is attached. The length of the barrel of the screw must therefore in that case be equal to the thickness of the column 2 less the thickness of one wall of this column.

This article of furniture may have one or more connecting elements which may be similar to the vertical elements and may be placed either horizontally or vertically between the two vertical elements 2. A tray (not shown in the figures) may be attached to a connecting element by means of screws engaging with screw tapped recesses in the connecting element.

If the connecting element 3 is flattened in the vertical direction it may be used to support a shelf which is kept in the horizontal position on the connecting element by means of two substantially U-shaped pieces fixed to its lower surface and seated astride the connecting element 3. Such a shelf is therefore constructed to be removable.

The vertical columns 2 may also have vertical grooves 18 in which the heads 19 of bolts 20 can slide up and down for fixing a connecting element 3 or flat elements on which a shelf is to be mounted.

Figure 3:
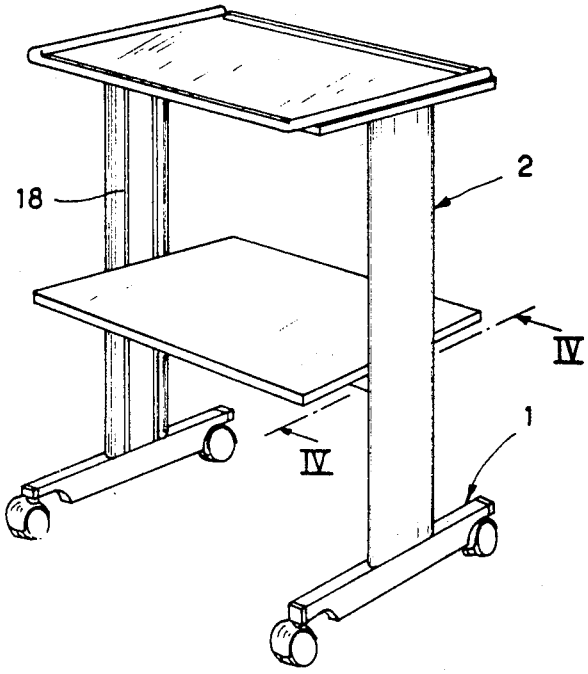
FIG. 3 is a view in perspective of another article of furniture according to the present invention comprising in particular a shelf placed between the upright columns which have vertical grooves on the surfaces facing each other.
Figure 4:
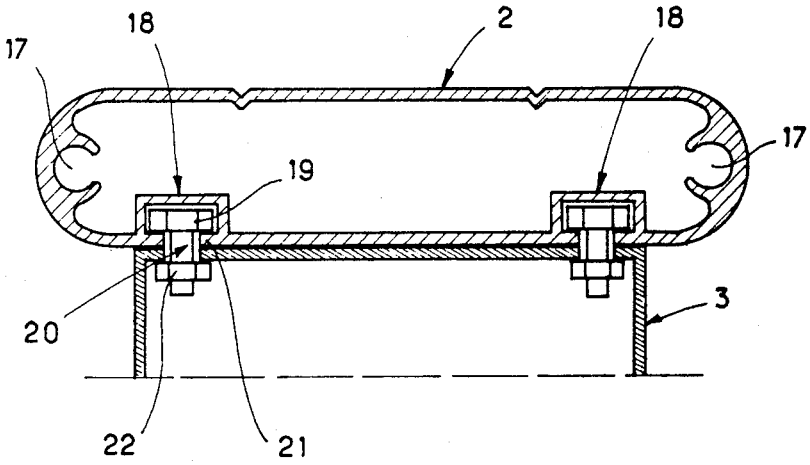
FIG. 4 is a horizontal section through a vertical column taken on the line IV—IV of FIG. 3.

Upright columns 2 of the kind described above are shown in FIGS. 3 and 4. They have at least two vertical grooves 18 on the surfaces facing one another. In cross-section, these grooves are constricted at 21 in the region where they open on to the surfaces of the columns. Their cross-section is generally polygonal (preferably rectangular or square) but may equally be elliptical. The head 19 of the screw or bolt 20 introduced into this groove 18 must not be capable of turning when the nut 22 is screwed to the bolt or screw 20 to hold in position a connecting element or flat element 3. In certain applications, it will be the nut 22 which is introduced into the vertical groove and held in position there and a bolt or screw will be fitted into this nut.

Thus to fix a connecting element to these vertical columns, the heads 19 of bolts or screws 20 are introduced into the vertical grooves 18, the threaded part of 20 projecting from the above-described constriction 21. These threaded parts are then passed through corresponding apertures in the connecting element 3 and fixed in position by a nut 22.

If a shelf does not have downwardly projecting edges, it is necessary, unless it is to be fixed like the previously described connecting element, to attach in a like manner two flat elements or angle pieces enabling the shelf to be placed between the two vertical columns.

The tray 4 situated at the top of the vertical columns 2 is attached to them by screws engaging with the longitudinal tubular elements on each vertical column 2.

According to a preferred embodiment, the tray 4 has a bar 18 which projects from the tray on one of its sides to form a grip enabling the user to move the article of furniture more easily. This bar may consist, for example, of a U-shaped tube or section having its base projecting from the tray and its arms forming lateral boundaries at opposite ends of the tray.

What I claimed is:

1. An article of furniture having a base fitted with castors, constituted by at least two bars substantially parallelepiped in form, each comprising an upper web and a lower web and side webs therebetween forming, respectively, the upper and lower and side surfaces of the bar, and each equipped with at least one castor, wherein each bar also has an intermediate web parallel to and situated between said upper and lower webs and extending between said side webs and having a cutaway portion in said bottom web and side webs and extending upward to said intermediate web at the ends of said parallelepiped for the accommodation of each castor each of said castors being fixed to said intermediate web in a said cutaway portion, said article of furniture further having two columns, one of said columns being fixed to one of said bars and the other of said columns being fixed to the other of said bars, said columns being connected together by at least one connecting element and supporting a tray or the like at their top, each of said columns being fixed to each of said bars by at least two barrel screws, the lower web and the intermediate web or each of said bars having corresponding apertures substantially of the same diameter as the barrel of said screw and the upper web of said bars having an aperture substantially equal in diameter to the threaded portion of said barrel screw, the barrel screw having a barrel at least equal in height to the distance between the upper web and the intermediate web.

2. Article of furniture according to claim 1, wherein the end of the bar having the cutaway portion is closed by an end piece having tongues extending into the space between the upper and the intermediate web.

3. Article of furniture according to claim 1, wherein each vertical column is rectangular in cross-section and provided with two longitudinal tubular elements each of which is designed to cooperate with the threaded part of the corresponding barrel screw.

4. Article of furniture according to claim 1 wherein each connecting element is fixed to each column by at least one barrel screw the length of which is at least equal to the thickness of the said vertical column minus the thickness of one wall of said column.

5. Article of furniture according to claim 1 wherein the tray situated at the top of the vertical columns is fixed to said columns by screws cooperating with longitudinal tubular elements provided in each vertical column.

6. Article of furniture according to claim 5, wherein the said tray has a bar forming a handle on one of its sides.

7. Article of furniture according to claim 1, wherein each column of said columns has a surface facing the surface of the other of said columns with at least two vertical grooves which in cross-section have a constriction in the region where they open on to the said surfaces.

8. Article of furniture according to claim 7, wherein the cross-section of the said vertical grooves is polygonal.

9. Article of furniture according to claim 7, wherein the cross-section of the said vertical grooves is elliptical.

* * * * *